US008167129B2

(12) United States Patent
Hatcher

(10) Patent No.: US 8,167,129 B2
(45) **Date of Patent: *May 1, 2012**

(54) FOOD TRAY WITH NON-SLIP INSERTS

(75) Inventor: Ashley Hatcher, Columbus, GA (US)

(73) Assignee: Archer Innovations, LLC, Columbus, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/368,144

(22) Filed: Feb. 9, 2009

(65) Prior Publication Data

US 2009/0139890 A1 Jun. 4, 2009

Related U.S. Application Data

(63) Continuation of application No. 11/421,552, filed on Jun. 1, 2006, now Pat. No. 7,506,763.

(51) Int. Cl.
*B65D 25/16* (2006.01)
*A47G 19/02* (2006.01)

(52) U.S. Cl. ..... 206/565; 206/564; 220/495.03; 220/574.3; 220/575

(58) Field of Classification Search ..... 206/557–565; 220/495.03, 574–575; D7/553.5
See application file for complete search history.

(56) References Cited

U.S. PATENT DOCUMENTS

| | | | |
|---|---|---|---|
| 224,632 | A | 2/1880 | Berry |
| 2,878,932 | A | 3/1959 | Martire |
| 3,231,718 | A | 1/1966 | Vasile |
| 3,305,124 | A | 2/1967 | Whiteford |
| D216,869 | S | 3/1970 | Britt |
| 3,808,084 | A | 4/1974 | Doty |
| D235,301 | S | 6/1975 | Mountain, Jr., et al. |
| D242,515 | S | 11/1976 | Shumrak |
| 4,005,745 | A | 2/1977 | Colato et al. |
| 4,019,022 | A | 4/1977 | Seider et al. |
| 4,093,041 | A | 6/1978 | Davis |
| 4,194,109 | A | 3/1980 | Springer |
| D255,527 | S | 6/1980 | Seager |
| D270,506 | S | 9/1983 | Thorne |
| 4,737,390 | A | 4/1988 | Fricano et al. |

(Continued)

FOREIGN PATENT DOCUMENTS

| | | |
|---|---|---|
| FR | 2 653 705 | 5/1991 |

(Continued)

OTHER PUBLICATIONS

Notification of Transmittal of the International Search Report and the Written Opinion of the International Searching Authority, or the Declaration, dated Jul. 23, 2008.

*Primary Examiner* — Bryon Gehman
(74) *Attorney, Agent, or Firm* — Hunton & Williams LLP

(57) ABSTRACT

A tray system, comprising one or more retaining portions for a food container, the one or more retaining portions receiving and securely holding fitted non-slip inserts. The tray system includes one or more feet which are of a depth at least equal to deepest recessed retaining portion of the tray. The feet may allow the tray to sit stably on a flat surface. The tray may have a non-slip removable insert inserted into the retaining portion which may be fitted to the bottom of the retaining portion and may maintain grip on serving tray and food container.

22 Claims, 4 Drawing Sheets

U.S. PATENT DOCUMENTS

| | | | | |
|---|---|---|---|---|
| 4,744,597 | A | | 5/1988 | Bauman et al. |
| D335,796 | S | | 5/1993 | Barnes |
| D335,797 | S | | 5/1993 | DeGrow |
| D338,374 | S | * | 8/1993 | Jacobson ..... D7/552.2 |
| 5,368,183 | A | | 11/1994 | Singer |
| D363,857 | S | | 11/1995 | Sussman |
| 5,497,885 | A | | 3/1996 | Sussman |
| D374,798 | S | | 10/1996 | Pippins, Jr. |
| 5,580,037 | A | | 12/1996 | Gore |
| D379,135 | S | | 5/1997 | Vina |
| D399,095 | S | | 10/1998 | Schmidt |
| 6,029,843 | A | | 2/2000 | Kroscher et al. |
| D423,290 | S | | 4/2000 | Green |
| D426,110 | S | | 6/2000 | Schmidt |
| D433,283 | S | | 11/2000 | Thomas |
| D470,712 | S | | 2/2003 | Swinford et al. |
| 6,814,235 | B2 | | 11/2004 | Wang |
| D505,833 | S | | 6/2005 | Ahearn |
| D545,523 | S | | 6/2007 | Goldberg et al. |
| D547,597 | S | | 7/2007 | Levy et al. |
| D560,099 | S | | 1/2008 | Hatcher |
| D576,449 | S | | 9/2008 | Boudewijns |
| D581,203 | S | | 11/2008 | Simon et al. |
| D590,655 | S | | 4/2009 | Freeman |
| D599,610 | S | | 9/2009 | Logan |
| D604,099 | S | | 11/2009 | Mishan |
| D608,150 | S | | 1/2010 | Lilly |
| D623,902 | S | | 9/2010 | Henderson et al. |
| D634,584 | S | | 3/2011 | Bergkvist |
| D642,408 | S | | 8/2011 | Pirkl |
| 2003/0205645 | A1 | | 11/2003 | Kaposi |

FOREIGN PATENT DOCUMENTS

| | | |
|---|---|---|
| WO | WO 94/14361 | 7/1994 |

* cited by examiner

FOOD TRAY WITH NON-SLIP INSERTS

CROSS-REFERENCE TO RELATED APPLICATIONS

This patent application is a Continuation (CON) of U.S. patent application Ser. No. 11/421,552, filed on Jun. 1, 2006 entitled "Food Tray with Non-Slip Inserts," issued on Mar. 24, 2009 as U.S Pat. No. 7,506,763, which is hereby incorporated by reference in its entirety.

FIELD OF THE INVENTION

The present invention relates to a food tray having non-slip inserts.

BACKGROUND OF THE INVENTION

Many devices exist for serving food. Some systems include indentations and surface coverings but have known drawbacks.

SUMMARY OF THE INVENTION

According to an embodiment of the present invention, a tray system is provided that comprises one or more retaining portions for a food container, the retaining portions receiving and securely holding fitted non-slip inserts. The tray system may contain one or more feet which may be of a depth at least equal to the deepest recessed portion of the tray, such that the one or more feet may allow the tray to sit stably on a flat surface. The tray system may contain one or more non-slip inserts inserted into the one or more portions, which may be fitted to the bottom of the portions. The inserts may maintain grip on the serving tray and a food container and may be removable and reusable. The removal of the inserts may facilitate ease of cleaning and prevent buildup of dirt underneath traction surfaces. The tray and inserts may be composed of materials that are dishwasher safe. The tray may be stackable. The one or more inserts may be interchangeable such that inserts from one tray may be utilized for another tray, allowing a tray's inserts to be replaced or their color to be varied. The tray may have handles at two opposite edges thereof; the handles may have a slotted portion therein for gripping.

Other advantages will be appreciated by one of ordinary skill in the art upon review of the entirety of this patent application.

DETAILED DESCRIPTION

Exemplary embodiments of the invention are discussed in detail below. While specific exemplary embodiments are discussed, it should be understood that this is done for illustration purposes only. A person skilled in the relevant art will recognize that other components and configuration can be used without departing from the spirit and scope of the invention.

Figure 1:
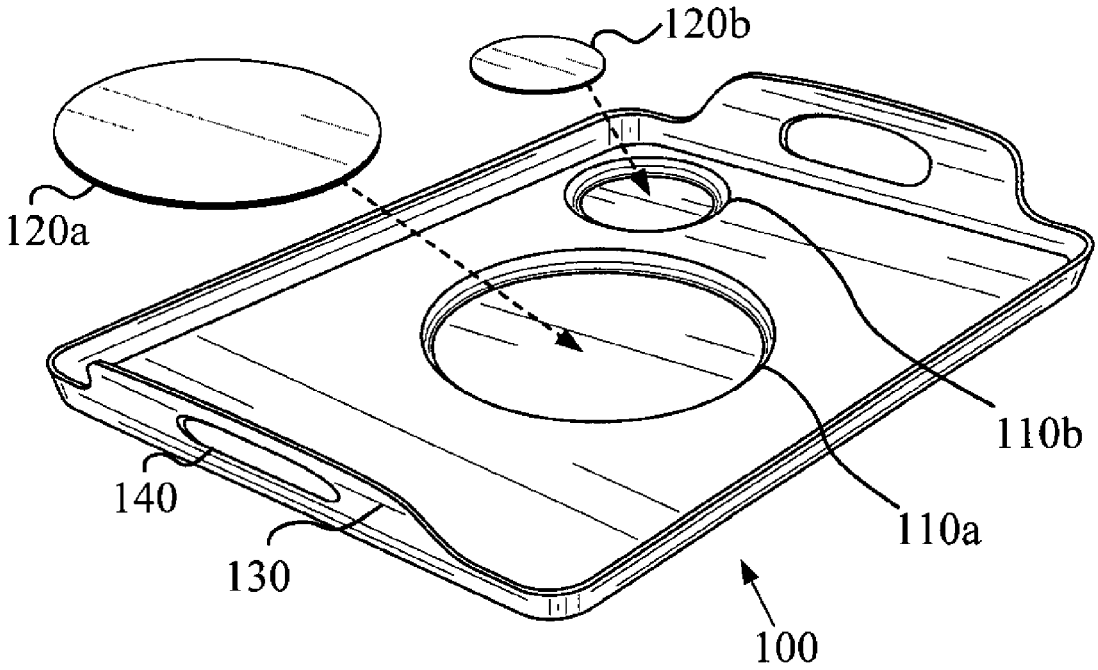
FIG. 1 depicts a top, angled view of a food tray with recessed portions and inserts according to an embodiment of the present invention.

As discussed above, various embodiments and iterations of the present invention relate to a food tray. FIG. 1 illustrates a tray 100 which has a main body including one or more retaining portions 110. In some embodiments retaining portion 110 may be recessed. In other embodiments retaining portion 110 may be formed by using one or more raised surfaces. In some embodiments the tray 110 may be composed of the chemical compound melamine. In some embodiments tray 100 may be formed using a plastic. In some embodiments the tray 100 may be composed of wood, metal, glass or other materials or some combination thereof. In some embodiments the tray 100 may be made of substances that are dishwasher safe. In some embodiments, tray 100 may comprise a tray with one or more handles 130 for gripping the tray. In one embodiment the tray may comprise a tray with handles at two opposite edges thereof; the handles may comprise a handle 130 a slotted portion 140 therein for gripping. The retaining portions 110 may be designed to receive one or more inserts 120. Inserts 120 may fit in retaining portions 110. Inserts 120 may also grip securely to tray 100. Inserts 120 may provide traction for serving containers such that when tray 100 is not level the inserts may greatly reduce the chance of container slippage. In some embodiments inserts 120 may be silicon based. In other embodiments the inserts 120 may be composed of rubber or other suitable materials or some combination thereof. In some embodiments inserts 120 may be permanently affixed to the bottom of retaining portions 110. In some embodiments inserts 120 may be composed of non-stick materials. In some embodiments inserts 120 may be removed for cleaning to prevent the buildup of dirt underneath the inserts 120. Inserts 120 may be made of substances that are dishwasher safe. Inserts 120 may subsequently be reused. Inserts 120 also may be printed in a variety of colors, with various designs or logos so that users of tray 100 may change the appearance of the tray 100 for personal taste, marketing or other reasons by switching inserts. In some embodiments the ease of removal of inserts 120 may also allow for replacement of inserts in the event an insert is worn or damaged.

Figure 2:
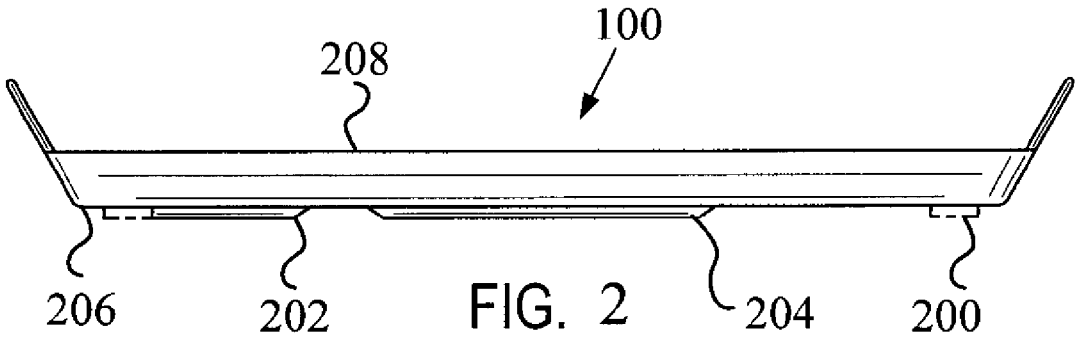
FIG. 2 depicts a side view of a food tray with recessed portions and inserts according to an embodiment of the present invention.
Figure 3:
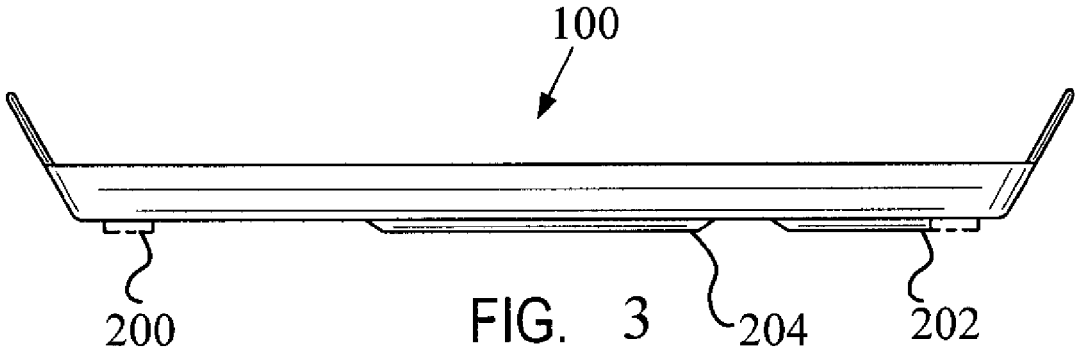
FIG. 3 depicts a side view of a food tray with recessed portions and inserts according to an embodiment of the present invention.

FIGS. 2 and 3 illustrate a side view of tray 100. Food tray 100 may comprise a tray with one or more feet 200. Feet 200 in some embodiments offset recessed portions 202 and 204 respectively such that when the tray 100 is placed on a flat surface it may sit stably. The height of feet 200 in some embodiments may be equal to or greater than the depth of the deepest recessed portion of their respective trays so that they may achieve this stability. In some embodiments tray 100 may be constructed such that the bottom 206 of tray 100 is a smaller perimeter than the perimeter of top 208 of tray 100. In such an embodiment the bottom perimeter of recessed portions 202 and 204 would also be smaller than their respective top perimeters. This embodiment may permit tray 100 to be stackable.

Figure 4:
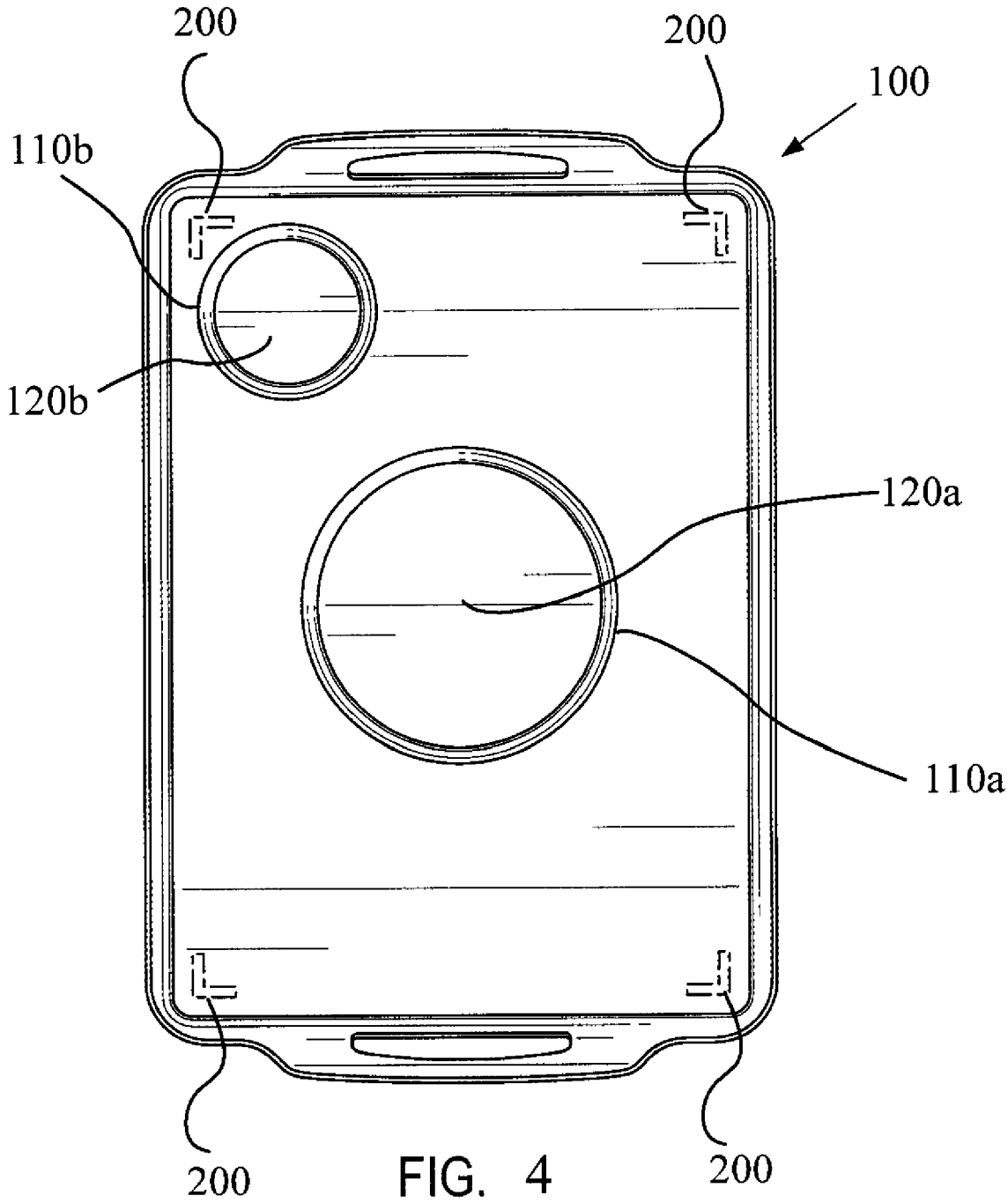
FIG. 4 depicts a top view of a food tray with recessed portions and inserts according to an embodiment of the present invention.

FIG. 4 illustrates a top view of tray. Inserts 120 are shown inserted into retaining portions 110. Some embodiments of tray 100 may be a round shape, an oval shape, a square shape or other practical shapes. Other embodiments of tray 100 may have a different arrangement or number of retaining portions. In some embodiments tray 100 may contain more than one retaining portion which may be designed for different types of serving containers. In some embodiments one retaining portion **110*b* may be designed for holding a glass or other beverage container and retaining portion 110*a* may be designed for holding a plate. One embodiment of tray 100 may contain a retaining portion for silverware. Other embodiments consider retaining portions for multiple dishes for a serving tray. Another embodiment of tray 100 contains a retaining portion for medical utensils to provide a safe, orderly arrangement during medical or dental procedures. Other embodiments of tray 100 may have retaining portions specialized to hold containers or tools particular to a specific industry. While FIG. 4 illustrates the retaining portions as circular, other shapes including square, oval or rectangular shapes may be utilized. In one embodiment of food tray 100 no retaining portion is utilized and insert 120 is designed to fit a portion or portions of the top side of the tray and to grip to the tray directly. When inserts 120 are in place in retaining portions 110** they may lay flat and may provide a even gripping surface for food containers.

Figure 5:
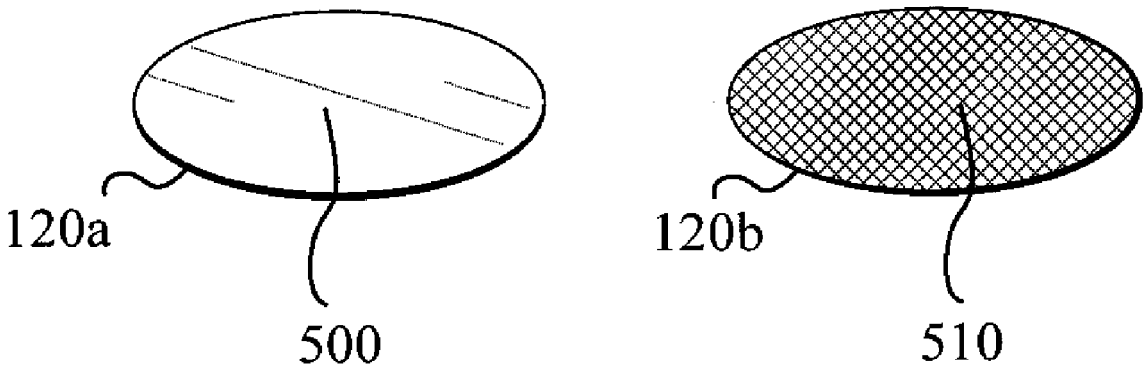
FIG. 5 depicts a view of both sides of an insert showing the smooth side and an opposite side with a raised pattern.

FIG. 5 illustrates view of both sides of insert 120 showing side 120*a* with smooth texture 500 and an opposite side 120*b* with a design 510 to facilitate grip on moist containers. In some embodiments this design may be a raised crosshatch or grid pattern. In some embodiments both sides of insert 120 may be smooth. In some embodiments both sides of insert 120 may be have a design to facilitate grip on moist containers. A variety of designs consisting of raised or grooved patterns may be utilized so that insert 120 may retain grip on a food or beverage container when the container or insert is moist. The insert 120 may be placed in the retaining portion 110 of tray 100 so that either side is facing up. If the side 120*b* is facing up it may facilitate grip on a serving container by reducing slippage of a food container if there is moisture on the insert or the food container. In some embodiments this may be used to reduce slippage of "sweating" glasses. The crosshatch pattern may be a pattern that is not significantly raised such that it does not significantly affect the appearance of the design of the insert but still reduces the slippage of moist food containers.

Some of the terminology used herein may be understood as follows:

Melamine is the chemical compound (triamino-triazine—C3N6H6), comprising carbon, nitrogen and hydrogen.

While the foregoing description includes details and specificities, it should be understood that such details and specificities have been included for the purposes of explanation only, and are not to be interpreted as limitations of the present invention. Many modifications to the embodiments described above can be made without departing from the spirit and scope of the invention, as it is intended to be encompassed by the following claims and their legal equivalents.

The invention claimed is:

1. A tray apparatus, comprising:

a substantially planar surface comprising a retaining portion, recessed into the substantially planar surface, for retaining a food container; and a substantially planar removable insert for maintaining grip on the retaining portion and the food container, wherein a first side of the insert differs from a second side of the insert in surface texture, and the insert is configured to entirely fit within the retaining portion and does not extend beyond an upper plane of the retaining portion, and the grip between the retaining portion and the insert is maintained by at least one gripping quality related to the surface texture of the insert.

2. The tray apparatus of claim 1, further comprising one or more feet protruding from the bottom of the substantially planar surface to allow the tray apparatus to sit stably on a flat surface without the substantially planar surface contacting the flat surface.

3. The tray apparatus of claim 1, wherein the insert comprises a material based on at least one of silicon, melamine, and rubber.

4. The tray apparatus of claim 1, wherein the first side of the insert has a decorative appearance different from the second side of the insert.

5. The tray apparatus of claim 4, wherein the decorative appearance comprises at least one of a logo, emblem, design, writing, color, and pattern.

6. The tray apparatus of claim 1, wherein the gripping quality comprises at least one of friction, traction, tackiness, and surface texture.

7. The tray apparatus of claim 1, wherein the tray apparatus is stackable with others of the tray apparatus.

8. The tray apparatus of claim 1, wherein the tray apparatus and the insert are dishwasher safe.

9. The tray apparatus of claim 1, further comprising one or more handles connected to the substantially planar surface for gripping and carrying the tray apparatus.

10. A tray apparatus, comprising:

a substantially planar surface comprising one or more retaining portions for retaining a food container; and at least one removable insert for maintaining grip on the one or more retaining portions and the food container, wherein a first side of the at least one insert is different in appearance from a second side of the at least one insert, wherein the grip is maintained by at least one gripping quality of the at least one insert, and wherein the first side of the at least one insert is different in surface texture from the second side of the at least one insert.

11. The tray apparatus of claim 10, wherein the first side of the at least one insert has a smooth surface and the second side of the at least one insert has a non-smooth surface.

12. The tray apparatus of claim 11, wherein the non-smooth surface comprises at least one of a raised surface, a grooved surface, and a patterned surface.

13. The food tray system of claim 12, wherein the patterned surface comprises at least one of a grid pattern surface and a crosshatch surface.

14. A food tray system, comprising:

a tray comprising a substantially planar surface for retaining a food container within at least one retaining portion that is recessed into the substantially planar surface;

one or more feet protruding from the bottom of the substantially planar surface to allow the tray to sit stably on a flat surface;

one or more handles connected to the substantially planar surface for gripping and carrying the tray; and at least one substantially planar, removable and reusable silicon-based insert for maintaining grip on the at least one retaining portion and the food container, wherein a first side of the at least one insert differs in surface texture from a second side of the at least one insert, and each at least one removable insert is configured to entirely fit within each at least one retaining portion and not extend beyond an upper plane of each at least one retaining portion, and the grip between the at least one insert and the at least one retaining portion is maintained by at least one gripping quality related to the surface texture of the at least one insert.

15. The food tray system of claim 14, wherein the tray comprises melamine.

16. The food tray system of claim 14, wherein the first side of the at least one insert has a smooth surface and the second side of the at least one insert has a non-smooth surface, the non-smooth surface comprising at least one of a raised surface, a grooved surface, and a patterned surface.

17. The food tray system of claim 16, wherein the patterned surface comprises at least one of a grid pattern surface and a crosshatch surface.

18. The food tray system of claim 14, wherein the first side of the at least one insert has a decorative appearance different from the second side of the at least one insert, the decorative appearance comprising at least one of a logo, emblem, design, writing, color, and pattern.

19. The tray apparatus of claim 14, wherein the at least one insert is dishwasher safe.

20. A food tray, comprising:

a substantially planar tray surface for retaining a food container within at least one retaining portion that is recessed into the substantially planar tray surface;

one or more feet protruding from the bottom of the substantially planar tray surface to allow the food tray to sit stably on a flat surface;

one or more handles connected to the substantially planar tray surface for gripping and carrying the food tray; and at least one substantially planar, removable and reusable silicon-based insert for maintaining grip on the at least one retaining portion and the food container, wherein a first side of the at least one insert differs in surface texture from a second side of the at least one insert, and the entire at least one insert is configured to fit within the at least one retaining portion and does not extend beyond an upper plane of the at least one retaining portion, and wherein the grip between the at least one insert and the at least one retaining portion is maintained by at least a traction property based on the surface texture of the at least one insert, and wherein further the food tray and the at least one insert are dishwasher safe.

21. A tray apparatus, comprising:

a substantially planar surface comprising at least two retaining portions, each of the at least two retaining portions is configured to retain a food or beverage container; and at least two substantially planar removable inserts each configured to maintain grip on each of the one of the at least two retaining portions and the food or beverage container, wherein a first side of the at least two inserts differs in surface texture from a second side of the at least two inserts, and a first insert of the at least two inserts is configured to entirely fit within a first retaining portion of the at least two retaining portions and a second insert of the at least two inserts is configured to entirely fit within a second retaining portion of the at least two retaining portions and the first and second inserts are configured such that each insert does not extend beyond an upper plane of each of the respective at least two retaining portions that the inserts is configured to fit within, and wherein the grip is maintained by a gripping quality of each of the at least two inserts and the gripping quality is related to the surface texture.

22. A tray apparatus, comprising:

a substantially planar surface comprising a retaining portion for retaining a food or beverage container, wherein the retaining portion has an area that is less than an area of the substantial planar surface and is recessed into the substantially planar surface; and a substantially planar removable insert for maintaining grip, based on a gripping quality of a surface texture of the substantially planar insert, on the retaining portion and the food or beverage container, wherein the entire insert is configured to fit within the area of the retaining portion and does not extent beyond an upper plane of the retaining portion and at least one side of the substantially planar insert has the surface texture for maintaining grip.

* * * * *